United States Patent [19]

Dye et al.

[11] Patent Number: 5,038,714

[45] Date of Patent: Aug. 13, 1991

[54] MASONRY COLORING STENCIL

[76] Inventors: Robert E. Dye, Rte. 5, Box 162; Kenneth W. Turner, Rte. 2, Box 51; both of Madisonville, Tenn. 37354

[21] Appl. No.: 318,657

[22] Filed: Mar. 3, 1989

[51] Int. Cl.[5] ..... B05C 17/06

[52] U.S. Cl. ..... 118/504; 118/301

[58] Field of Search ..... 118/504, 505, 301, 406, 118/15, 16, 83, 134, 114.1; 264/313, 261, 256, 333; 33/563; 52/744; 427/272

[56] References Cited

U.S. PATENT DOCUMENTS

| | | | |
|---|---|---|---|
| 1,571,849 | 2/1926 | Long | 264/256 |
| 1,937,927 | 12/1933 | Weber | 425/115 |
| 2,059,520 | 11/1936 | Harshberger | 264/313 |
| 2,264,628 | 12/1941 | Engert et al. | 156/250 |
| 2,807,070 | 9/1957 | Thomas | 249/15 |
| 3,096,195 | 7/1963 | Seman et al. | 266/256 |
| 3,225,691 | 12/1965 | Kehe | 101/127 |
| 3,323,490 | 6/1967 | McGilliland | 118/504 |
| 3,552,987 | 1/1971 | Smith | 427/197 |
| 3,667,990 | 6/1972 | Rogers | 427/282 |
| 3,678,887 | 7/1972 | Smith | 118/504 |
| 3,961,602 | 6/1976 | Dresser | 118/505 |
| 3,962,989 | 6/1976 | Groff | 118/504 |
| 4,024,837 | 5/1977 | Snyder | 118/505 |
| 4,031,268 | 6/1977 | Fairbairn | 427/12 |
| 4,125,658 | 11/1978 | Miles | 428/131 |
| 4,682,562 | 7/1987 | Hell | 118/500 |
| 4,822,650 | 4/1989 | Horiki et al. | 118/505 |

FOREIGN PATENT DOCUMENTS

| | | | |
|---|---|---|---|
| 0262946 | 4/1988 | European Pat. Off. | 118/504 |

*Primary Examiner*—Willard E. Hoag
*Attorney, Agent, or Firm*—Pitts and Brittian

[57] ABSTRACT

A masonry stencil for masking preselected mortar patterns on a masonry surface and an associated method for coloring or staining a masonry surface. The stencil comprises a latticework structure including an open framework of strips defining a pattern corresponding to the desired or the pre-existing mortar pattern of the masonry, and defining open spaces through which a coloring medium can be applied to the masonry surface. The stencil further comprises a gasket secured to the under surface of the latticework structure for sealably engaging the masonry surface. In accordance with the method of the present invention the masonry stencil is placed on the masonry surface so as to mask the desired mortar pattern or an existing mortar pattern, and a coloring medium is applied to the unmasked surface area exposed by the open spaces of the stencil. The stencil is then removed leaving the mortar pattern uncolored.

11 Claims, 4 Drawing Sheets

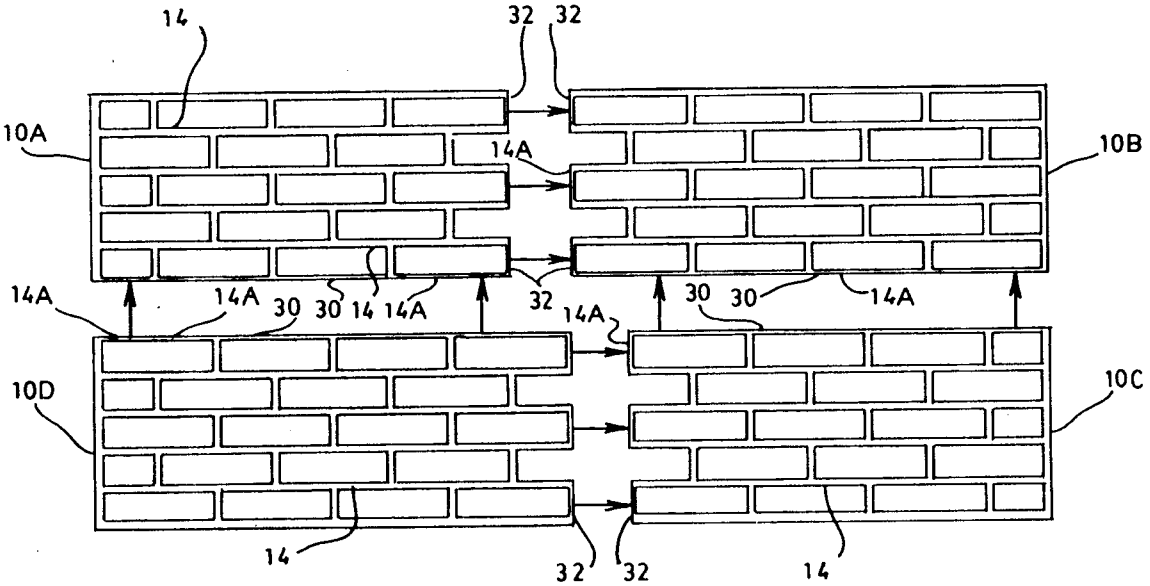
FIG. 5
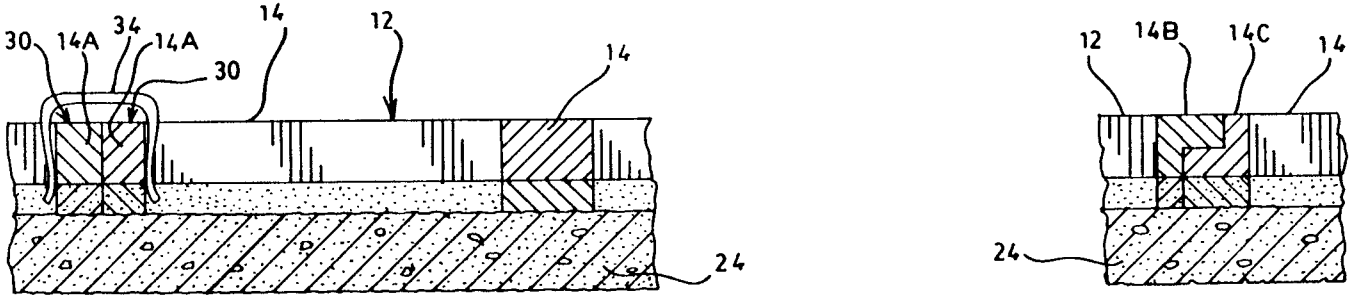
FIG. 6
FIG. 7

MASONRY COLORING STENCIL

TECHNICAL FIELD

This invention relates to a masonry stencil and an associated masonry coloring method for producing brick, tile, interlocking pavers, flag stone or the like patterns on an integral masonry surface, or for recoloring existing brick, tile, interlocking pavers, flag stone or the like masonry. In this particular invention the stencil includes a latticework structure provided with a gasket for sealably engaging a masonry surface.

BACKGROUND ART

It is generally recognized that whereas construction with brick, tile, interlocking pavers, flag stone or the like provides an attractive masonry surface, such construction can be very expensive and time consuming. Attempts have been made to devise wall covering which give the appearance of brick, tile, interlocking pavers, flag stone or the like, but such coverings rarely produce the natural appearance of brick, tile, interlocking pavers, flag stone or the like and, although less costly than natural brick, tile, interlocking pavers, flag stone or the like, such wall covering can still be quite costly. Further, where less costly masonry, such as concrete, is used, various paints and stains are available for covering or decorating the surface, but the painting or staining of large areas of concrete to give the appearance of brick, tile, interlocking pavers, flag stone or the like is very laborious where conventional methods are used. In this regard, stencils have been used as masking aides to produce complex designs which cover selected areas. For example, U.S. Pat. Nos. 4,682,562; 4,125,658; 4,031,268; 3,678,887; 3,667,990; 3,552,987; 3,323,490; 3,225,691; 2,264,628 and 1,937,927 discuss the use of such stencils. However, due to the porous, irregular surface characteristic of most concrete and other masonry the coloring medium tends to bleed or seep under the stencil into areas where colorization is not desired where conventional stenciling methods are used.

Difficulty has also been encountered finding cost efficient methods for recoloring faded brick, tile, interlocking pavers, flag stone or the like incorporated in older structures, or for changing the color of brick, tile, interlocking pavers, flag stone or the like in an existing structure, due to the need to avoid colorization of the mortar gaps. Of course, the painting of individual bricks or tiles is very time consuming, and traditional masking means, such as masking tapes, work poorly given the porous, irregular surface of the mortar.

Therefore, it is an object of the present invention to provide a masonry stencil for masking a preselected mortar pattern on a masonry surface.

It is a further object of the present invention to provide a method for coloring concrete and other masonry surface to give the surface the appearance of natural brick, tile, interlocking pavers, flag stone or the like construction.

Another object of the present invention is to provide a method for recoloring brick, tile, interlocking pavers, flag stone or the like masonry while maintaining the mortar gaps therebetween in their natural uncolored state.

Yet another object of the present invention is to provide a masonry stencil which is inexpensive to manufacture, and an associated masonry staining method which is inexpensive to use.

DISCLOSURE OF THE INVENTION

Other objects and advantages will be accomplished by the present invention which provides a masonry stencil for masking preselected mortar patterns on a masonry surface during the application of a coloring medium to the masonry surface, and an associated method whereby the stencil is utilized for coloring a masonry surface to produce the appearance of brick, tile, interlocking pavers, flag stone or the like construction or for recoloring existing brick, tile, interlocking pavers, flag stone or the like masonry. The stencil of the present invention generally comprises a latticework structure including an open framework of strips defining a pattern corresponding to the desired or pre-existing mortar pattern of the masonry, and defining open spaces through which a coloring medium can be applied to the masonry surface. The stencil further comprises a gasket secured to the under surface of the latticework structure for sealably engaging the masonry surface. In accordance with the method of the present invention the masonry stencil is placed on the masonry surface so as to mask the desired mortar pattern or an existing mortar pattern, and a coloring medium is applied to the unmasked surface area exposed by the open spaces of the stencil. After the coloring medium dries the stencil is removed leaving the mortar pattern uncolored.

BRIEF DESCRIPTION OF THE DRAWINGS

The above-mentioned features of the present invention will become more clearly understood from the following detailed description of the invention read together with the drawings in which:

FIG. 5 illustrates four masonry stencils of the present invention which are constructed to be releasably joined.

FIG. 6 illustrates a partial side elevation view, in section, of a masonry stencil of the present invention.

FIG. 7 illustrates a partial side elevation view, in section, of a masonry stencil of the present invention illustrating one embodiment of joining stencils.

BEST MODE FOR CARRYING OUT THE INVENTION

Figure 1:
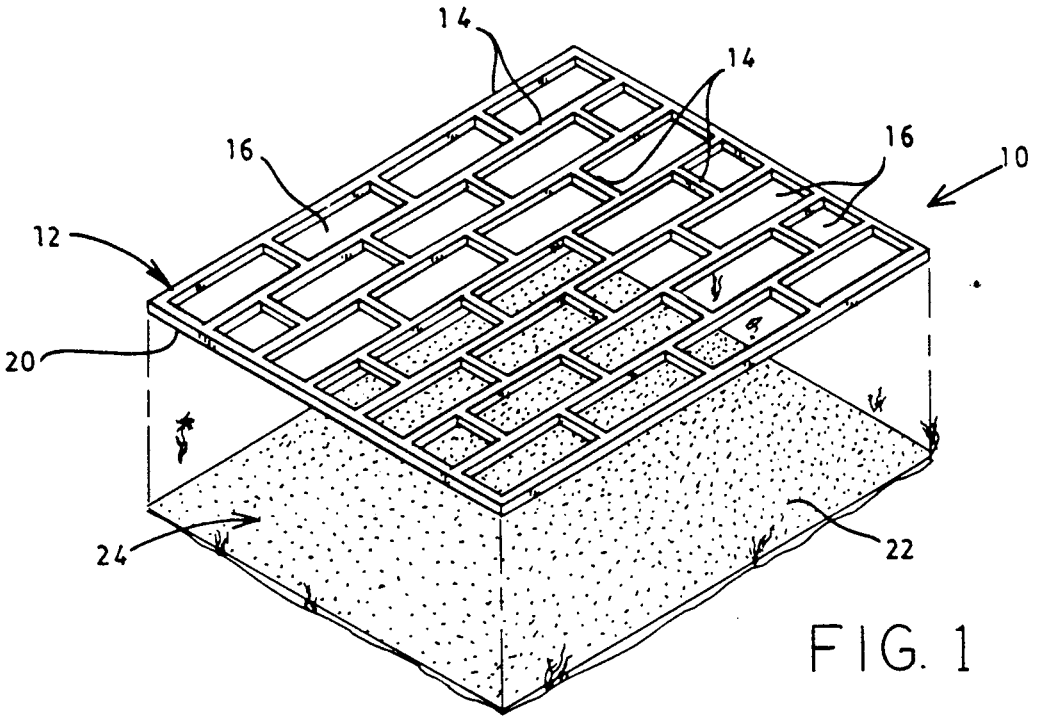
FIG. 1 illustrates a perspective view of a masonry stencil of the present invention.
Figure 2:
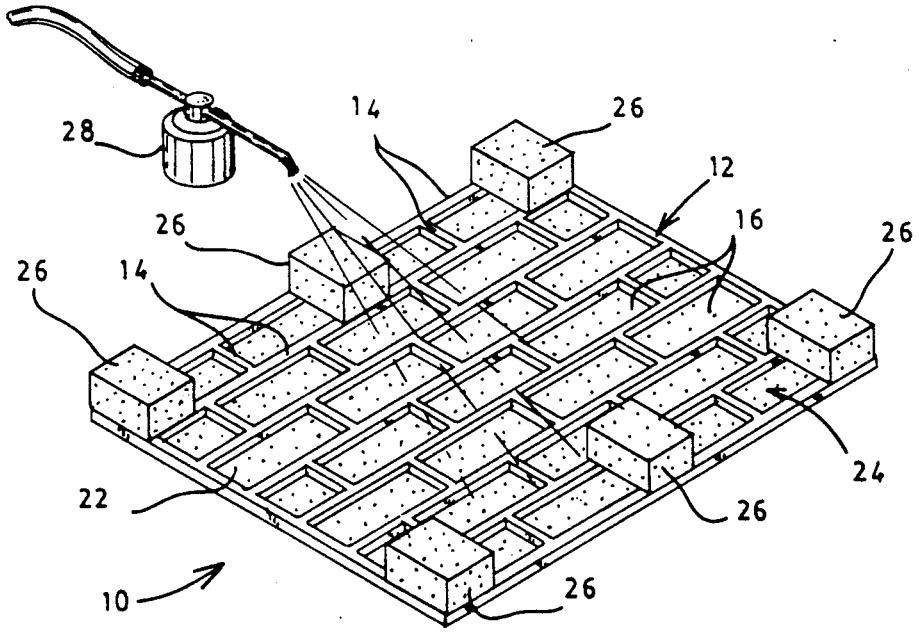
FIG. 2 illustrates a perspective view of a masonry stencil of the present invention as it engages a masonry surface.
Figure 4:
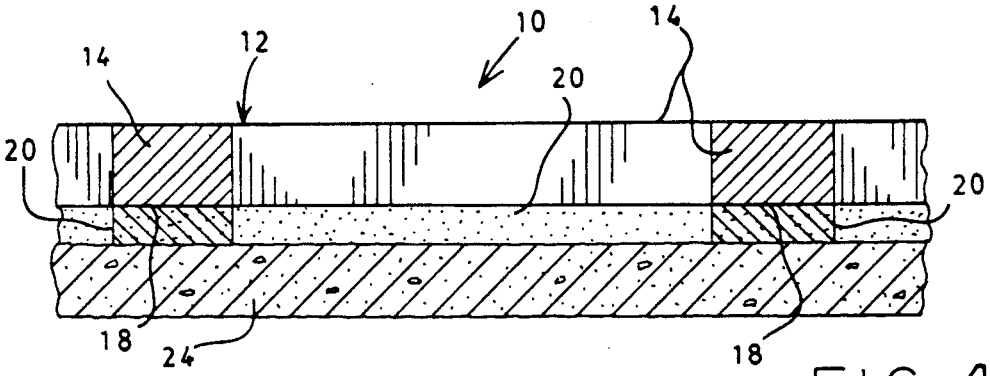
FIG. 4 illustrates a partial side elevation view, in section, of a stencil of the present invention.

A masonry stencil incorporating various features of the present invention is illustrated at 10 in FIGS. 1, 2 and 4. The stencil 10 is utilized in a related masonry staining or coloring method whereby a concrete surface or other masonry surfaces can be stained to give the appearance of brick, tile, interlocking pavers, flag stone or the like construction. Further, as will be discussed further below, the stencil 10 can be utilized in the staining of existing brick, tile, interlocking pavers, flag stone or the like surfaces to alter the color of the brick, tile, interlocking pavers, flag stone or the like or to refurbish faded brick, tile, interlocking pavers, flag stone or the like.

As illustrated in FIG. 1 the stencil 10 comprises a latticework structure 12 defining an open framework of strips 14 forming regular, patterned spaces 16. As will be discussed below, the pattern defined by the latticework structure 12 will vary depending upon the desired brick, tile, interlocking pavers, flag stone or the like design to be produced, with the structure formed by the strips 14 corresponding to the mortar pattern of the brick, tile, interlocking pavers, flag stone or the like. In this regard, and in accordance with the masonry staining method of the present invention, the strips 14 serve as a masking means which overlays the surface to be stained and masks the areas defining the desired, or existing, mortar pattern such that such areas are not stained.

In order to facilitate the masking of the mortar pattern the undersurface 18 of the latticework structure 12 is provided with a gasket 20. As best illustrated in FIG. 4, the gasket 20 serves to sealably engage the outer surface 22 of the concrete 24, or other masonry surface, and prohibits stain from bleeding or seeping under the stencil. The gasket 20 is preferably fabricated of a malleable, solvent resistant material such that the gasket material deforms under pressure to fill the pores and crevices of the irregular surfaces common to most masonry. Some examples of suitable gasket material are vinyl nitrite, Viton closed cell foam, and Teflon closed cell sponge foam. It will also be noted that in the preferred embodiment the latticework structure 12 is fabricated of a flexible, resilient material, such as a strong, durable plastic, metal, wood or the like such that the stencil 10 can conform to and closely engage an irregular masonry surface.

Figure 3:
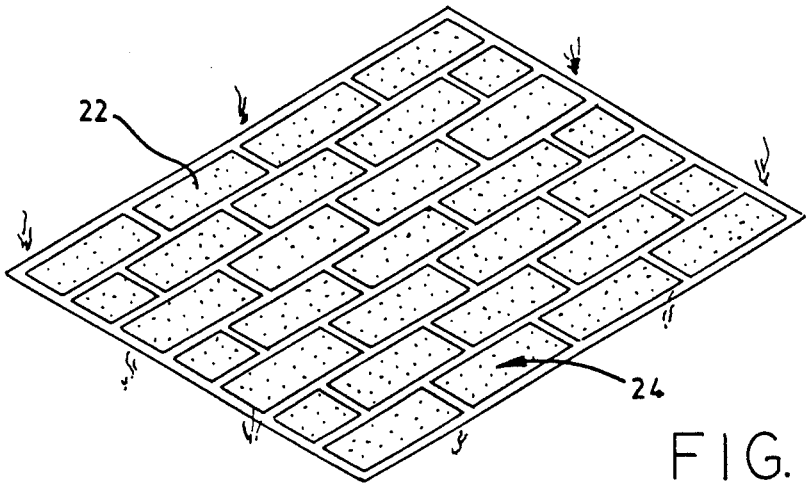
FIG. 3 illustrates a perspective view of a masonry surface after being stained in accordance with the method of the present invention.

The masonry staining method of the present invention is illustrated in FIG. 1, 2 and 3 as applied to create a brickwork design on the surface 22 of a small concrete slab 24. In accordance with this method the stencil 10 is placed over the surface 22 of the slab 24, as illustrated in FIG. 1, to mask the mortar pattern areas. Preferably, pressure is exerted on the stencil 10 toward the surface 22 to insure that the gasket 20 seals the mortar pattern area and the gasket material fills the pores and crevices of the surface. Preferably, weight members 26 are then placed at preselected positions to hold the stencil in flush engagement with concrete 24, as illustrated in FIG. 2. As is also illustrated in FIG. 2, a coloring medium, such as a stain or paint, is then applied to the concrete surface exposed by the spaces 16, using a suitable applicator such as the spraying device 28. It will be noted that where the weight members 26 overlay the spaces 14 of the stencil 10, movement of the weight members 26 may be required to stain or paint the area beneath the weight member 26. When application of the coloring medium is completed and the medium has dried, the stencil 10 is removed, thereby unmasking the mortar pattern areas and leaving the desired brick, tile, interlocking pavers, flag stone or the like pattern on the concrete surface 22 as illustrated in FIG. 3.

For most applications the preferred coloring medium is a stain comprising a blend of solvents which is capable of penetrating deeply into the concrete or other masonry. An example of one suitable stain is H & C Silicone Acrylic Concrete Stain, manufactured by FLR Paints, Inc, Bradenton, Fla. This deeply penetrating stain results in a natural brick, tile, interlocking pavers, flag stone or the like appearance, and can be readily utilized in the method of the present invention since bleeding or seepage of the stain under the stencil 10 is prohibited by the gasket 20.

It is contemplated that for certain applications where large areas are to be stained more than one stencil 10 will be required. Accordingly, the stencils of the present invention can be designed to engage, or interlock, with othe stencils as, for example, is illustrated in FIG. 5. In FIG. 5 each of the stencils 10A, 10B, 10C and 10D have outer edge portions 30 and 32 for engaging adjacent stencils. In this regard, in one preferred embodiment the edge portions 30 and 32 are constructed of stripes 14A which have one half the width of the strips 14 such that when abutting another strip 14A the combined width of the strips correspondes to the desired mortar gap width (See FIG. 6). Alternatively, the edge portions 30 and 32 can be constructed of strips having L-shaped cross-sections for releasably interlocking as illustrated at 14B and 14C in FIG. 7. Further, securing means can be provided for holding the stencils 10 together, such as, for example, the C-clip 34 illustrated in FIG. 6.

Figure 8:
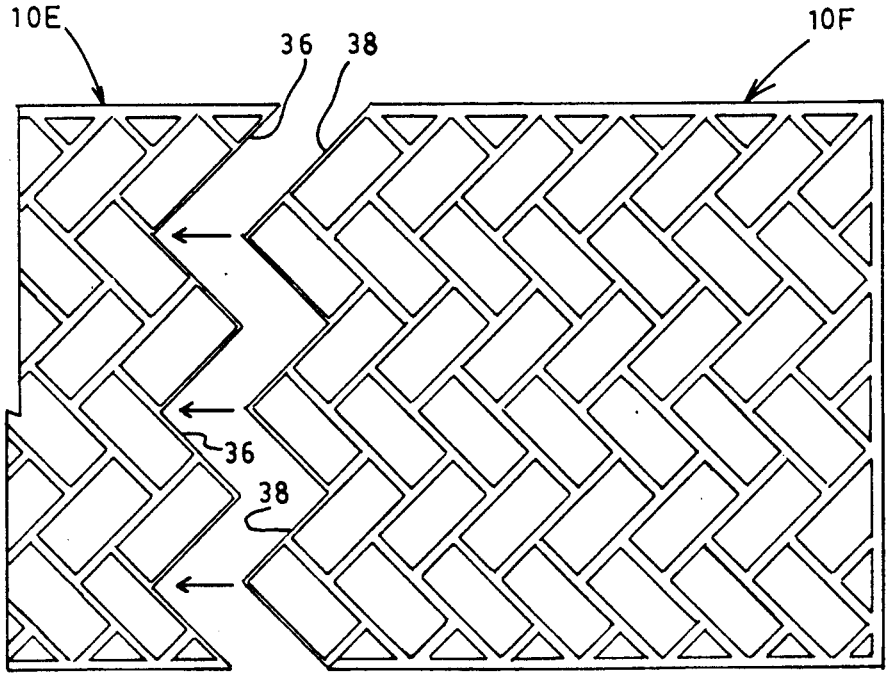
FIG. 8 illustrates a top view of an alternate embodiment of a stencil of the present invention illustrating another embodiment of joining stencils.

Another example of interlocking stencils is illustrated in FIG. 8 at 10E and 10F. It will be recognized that the edge portion 36 of the stencil 10E and the edge portion 38 of the stencil 10F can be joined to permit the staining of a larger area. It will also be noted that the stencils 10E and 10F define a Herringbone design for producing a Herringbone brick pattern.

Figure 9:
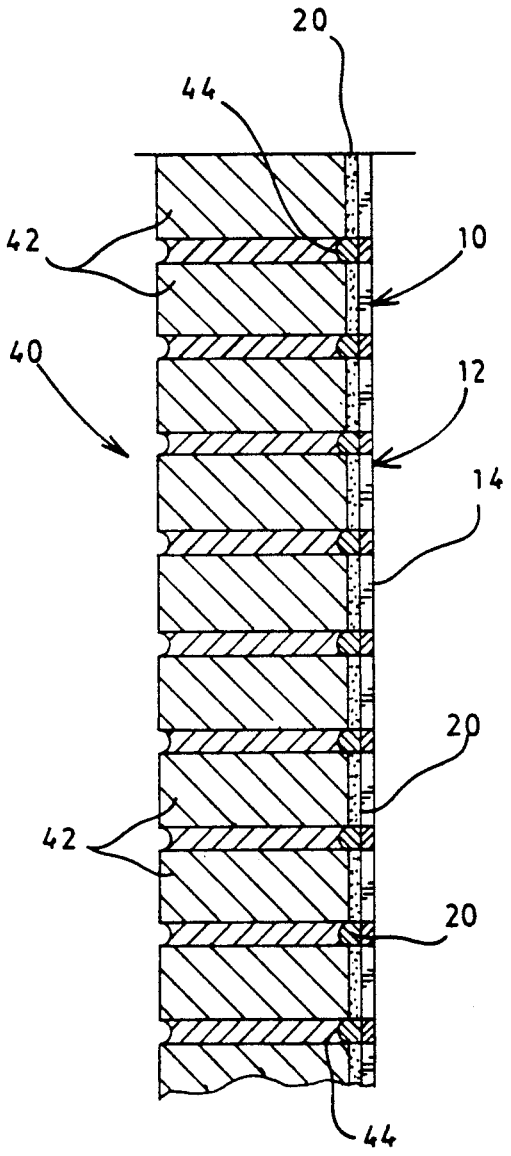
FIG. 9 illustrates a partial side elevation view, in section, of a stencil of the present invention as it engages the mortar gaps of a brick wall.

The stencil 10 and the method of the present invention can also be utilized to stain faded brick, tile, interlocking pavers, flag stone or the like in order to reproduce its original color, or can be utilized to change the color of the brick, tile, interlocking pavers, flag stone or the like. In this regard FIG. 9 illustrates the stencil 10 as it is positioned on a brick wall 40 in order to allow staining or re-coloring of the brick 42. As illustrated the gasket 20 is received in the mortar gaps 44, thereby masking the gaps 44. Accordingly, stain or paint can be applied to the brick without risk of staining or discoloring the mortar. In the preferred embodiment pressure will be applied to the stencil to hold it against the wall to assure a tight contact and no bleed-through.

In light of the above it will be recognized that the stencil 10 and the method of the present invention can be utilized not only to stain concrete surfaces to give the appearance of brick, tile, interlocking pavers, flag stone or the like construction, but can also be used to recolor existing brickwork or tile surfaces. Moreover, the gasket 20 of the stencil 10 insures that the coloring medium being used does not bleed into the mortar pattern being produced or the existing mortar gaps, thereby giving the stencil 10 great advantage over prior art.

While a preferred embodiment has been shown and described, it will be understood that there is no intent to limit the invention to such disclosure, but rather it is intended to cover all modifications and alternate constructions falling within the spirit and scope of the invention as defined in the appended claims.

We claim:

1. A masonry coloring stencil for masking a preselected mortar pattern on a masonry surface, said surface including pores and crevices, during the application of a liquid coloring medium to said masonry surface, said stencil comprising:

a latticework structure including an open framework of first strips, said framework defining a pattern corresponding to said preselected mortar pattern and defining open spaces through which said liquid coloring medium can be applied to said masonry surface, said latticework structure having an undersurface; and a gasket secured to said undersurface of said latticework structure for engaging said masonry surface to exclude said liquid coloring medium from areas other than said open spaces defined by said first strips of said latticework structure in accordance with said preselected mortar pattern, said gasket readily deformable under pressure against said surface so as to conform thereto.

2. The masonry coloring stencil of claim 1 wherein said gasket is fabricated of a resilient material, said gasket being deformable upon pressure or weight being applied to said latticework structure into said pores and crevices of said masonry surface as said stencil engages said masonry surface to thereby exclude said liquid coloring medium from areas defining said preselected mortar pattern.

3. A masonry stencil for masking a preselected mortar pattern on a masonry surface, said surface including pores and crevices, during the application of a liquid coloring medium to said masonry surface, said stencil comprising:

a latticework structure including an open framework of first strips, said framework defining a pattern corresponding to said preselected mortar pattern and defining open spaces through which said liquid coloring medium can be applied to said masonry surface, said latticework structure having an undersurface; and a gasket secured to said undersurface of said latticework structure for engaging said masonry surface to exclude said liquid coloring medium from areas defined by said preselected mortar pattern, wherein said gasket is fabricated of a material such that said gasket deforms into said pores and crevices of said masonry surface as said stencil engages said masonry surface to thereby exclude said liquid coloring medium from areas defining said preselected mortar pattern, said material of said gasket being vinyl nitrite.

4. A masonry stencil for masking a preselected mortar pattern on a masonry surface, said surface including pores and crevices, during the application of a liquid coloring medium to said masonry surface, said stencil comprising:

a latticework structure including an open framework of first strips, said framework defining a pattern corresponding to said preselected mortar pattern and defining open spaces through which said liquid coloring medium can be applied to said masonry surface, said latticework structure having an undersurface; and a gasket secured to said undersurface of said latticework structure for engaging said masonry surface to exclude said liquid coloring medium from areas defined by said preselected mortar pattern, wherein said gasket is fabricated of a material such that said gasket deforms into said pores and crevices of said masonry surface as said stencil engages said masonry surface to thereby exclude said liquid coloring medium from areas defining said preselected mortar pattern, said material of said gasket being Viton closed cell foam.

5. A masonry stencil for masking a preselected mortar pattern on a masonry surface, said surface including pores and crevices, during the application of a liquid coloring medium to said masonry surface, said stencil comprising:

a latticework structure including an open framework of first strips, said framework defining a pattern corresponding to said preselected mortar pattern and defining open spaces through which said liquid coloring medium can be applied to said masonry surface, said latticework structure having an undersurface; and a gasket secured to said undersurface of said latticework structure for engaging said masonry surface to exclude said liquid coloring medium from areas defined by said preselected mortar pattern, wherein said gasket is fabricated of a material such that said gasket deforms into said pores and crevices of said masonry surface as said stencil engages said masonry surface to thereby exclude said liquid coloring medium from areas defining said preselected mortar pattern said material of said gasket being Teflon closed cell sponge foam.

6. A masonry stencil for masking a preselected mortar pattern on a masonry surface, said surface including pores and crevices, during the application of a liquid coloring medium to said masonry surface, said stencil comprising:

a latticework structure including an open framework of first strips, said framework defining a variable pattern corresponding to said preselected mortar pattern and defining open spaces through which said liquid coloring medium can be applied to said masonry surface, said latticework structure having an undersurface and a gasket secured to said undersurface of said latticework structure for engaging said masonry surface to exclude said liquid coloring medium from areas defined by said preselected mortar pattern, wherein said stencil defines at least one side portion suitable for interlocking with other said stencils.

7. A masonry stencil for masking a preselected mortar pattern on a masonry surface, said surface including pores and crevices, during the application of a liquid coloring medium to said masonry surface, said stencil comprising:

a latticework structure including an open framework of first strips, said framework defining a pattern corresponding to said preselected mortar pattern and defining open spaces through which said liquid coloring medium can be applied to said masonry surface, said latticework structure having an undersurface; and a gasket secured to said undersurface of said latticework structure for engaging said masonry surface to exclude said liquid coloring medium from areas defined by said preselected mortar pattern, wherein said stencil defines at least one side portion suitable for interlocking with other said stencils, and wherein said side portion further defines at least one further strip, said further strip having a width substantially one half the width of said first strips.

8. A stencil unit for masking a preselected mortar pattern on a masonry surface to define preselected masonry shapes, said masonry surface having pores and crevices, during application of a liquid coloring medium to said masonry surface so as to prevent application of said coloring medium to said preselected mortar pattern, said stencil comprising:

a latticework structure formed from interlocking strips, said strips defining said preselected mortar pattern surrounding open areas for said preselected masonry shapes through which said liquid coloring medium can be applied to said masonry surface, said latticework structure having an undersurface; and a gasket secured to said undersurface of said latticework structure for engaging said masonry surface to exclude said coloring medium from said preselected mortar pattern defined by said strips, said gasket material selected from materials to seal said pores and crevices of said masonry surface and prevent absorption of said liquid coloring medium by said gasket.

9. The stencil unit of claim 8 wherein said latticework structure is fabricated of a resilient material to facilitate engaging of said gasket with an irregular masonry surface.

10. The stencil unit of claim 8 further comprising means for releasably joining said stencil unit to other stencil units.

11. The stencil unit of claim 10 wherein said stencil unit defines peripheral edges, and at least one peripheral edge is fabricated of a strip having a width one-half that of other of said strips whereby said strip of one-half width is releasably joined to a corresponding edge strip of other of said stencil units having a one-half width.

* * * * *